United States Patent [19]

Murata

[11] Patent Number: 4,882,111

[45] Date of Patent: Nov. 21, 1989

[54] METHOD FOR OBTAINING DRAIN-CAST HOLLOW ARTICLES

[75] Inventor: Kazushige Murata, Tokoname, Japan

[73] Assignee: INAX Corporation, Aichi, Japan

[21] Appl. No.: 894,497

[22] Filed: Aug. 4, 1986

[30] Foreign Application Priority Data

Aug. 6, 1985 [JP] Japan ..... 60-173922

[51] Int. Cl.[4] ..... B28B 1/26; B28B 7/12

[52] U.S. Cl. ..... 264/87; 249/66.1; 264/335; 264/336; 425/437

[58] Field of Search ..... 264/87, 86, 101, 571, 264/335, 336; 249/66 A, 66.1; 425/556, 437

[56] References Cited

U.S. PATENT DOCUMENTS

| | | | |
|---|---|---|---|
| 2,669,762 | 2/1954 | Blackburn et al. | 264/87 |
| 3,206,534 | 9/1965 | Vogele et al. | 264/336 |
| 3,461,194 | 8/1969 | Alexander | 264/86 |
| 3,594,462 | 7/1971 | Vrijma | 264/336 X |
| 3,594,465 | 7/1971 | Vrijma | 264/336 X |
| 3,792,149 | 2/1974 | Derror | 264/336 |
| 4,528,152 | 7/1985 | Aoyama et al. | 264/87 |

*Primary Examiner*—Jan H. Silbaugh
*Assistant Examiner*—Karen D. Kutach
*Attorney, Agent, or Firm*—Browdy and Neimark

[57] ABSTRACT

A method for drain-casting a slip to obtain a substantially hollow molded article 42 is provided, by the use of an apparatus including a divisible mold 21 including an upper mold portion 22, a lower mold portion 23, and at least two side mold portions 24, 25 to form a mold cavity 38, each mold portion containing a filter member and a water-drainage means, and the lower portion having a slip supply duct 40. The method includes pressurizing a slip introduced into the mold cavity 38 to deposit the slip onto the filter members, draining an undeposited slip through the slip supply duct 40, removing the upper and lower mold portions 22, 23 by applying compressed air to the water-drainage means 34, 35 of the mold portions to exude some water between the filter members 30, 31 and the resulting molded article 42, holding and supporting the molded article 42 between the side mold portions 24, 25, applying compressed air to the water-drainage means 36, 37 as described above, and thus demolding the molded article 42 on the stand 43 safely.

21 Claims, 3 Drawing Sheets

METHOD FOR OBTAINING DRAIN-CAST HOLLOW ARTICLES

BACKGROUND OF THE INVENTION

This invention relates to a method for obtaining drain-cast hollow articles. More particularly, this invention relates to a method for drain-casting a slip to obtain substantially hollow molded articles. Such hollow articles drain-cast with a ceramic slip are especially useful, which are then fired to produce substantially hollow ceramic or porcelain ware such as sanitary ware, art ware, other ceramic ware vessels, and the like. Moreover, such hollow articles having complicated appearances can be efficiently produced according to the present invention.

Conventional methods for drain-casting slips comprise, for example, filling the mold cavity of a divisible gypsum mold which has been dried with a slip, depositing the slip onto the surface of the gypsum mold by the action of gypsum in absorbing water from the slip, draining undeposited slip remaining in the mold by gravity, increasing the strength of the resulting molded article by having the moisture of the deposited slip absorbed into the gypsum mold, and then removing the mold by hand operations to obtain the molded article. Such conventional methods, however, produce only two or less molded articles in 8 hours due to the limited water-absorption capacity of a dried gypsum mold, and the used gypsum mold which has absorbed water needs drying for 6 to 18 hours before it can be reused. Moreover, the production capacity per working period is very low and also the use-life of such gypsum molds is short (about 80 cycles) due to the deterioration which occurs in prolonged drying. Thus, the production cost of such molded articles is considerably high.

In order to avoid troublesome manual operations and prolonged molding and demolding time as mentioned above, the present inventor proposed, as one of joint inventors, an automatic method for obtaining drain-cast hollow articles without substantial manual operations, as disclosed in U.S. Pat. No. 4,528,152 Specification the disclosure of which is incorporated herein by reference. The Aoyama et al. U.S. Patent is summarized below with reference to FIG. 5 (Prior Art) attached hereto. An apparatus for drain-casting a slip comprises a mold (1) including at least two divisible mating mold portions (2*a*, 2*b*) to form a mold cavity (4), a slip tank, a pump, air compressors, suction pumps, valves and tubings to connect them accordingly, supporting means (8) of the mold portions, and a stand. The mold portion (2*a*, 2*b*) includes an air-tight vessel (2) and a filter member (3, 3') inside the vessel, the filter member (3, 3') contains a water-drainage means (5, 5'), and the drainage means is communicated with the outside of the vessel. One of the mold portions has a slip supply duct (6) and one other mold portion has an overflow duct (7), which ducts communicate with the outsides of the vessels. A method using such apparatus to form hollow ceramic ware comprises pressurizing a slip introduced into the mold cavity (4) and preferably depressurizing the water-drainage means (5, 5') to deposit the slip onto the filter members (3, 3'), draining an undeposited slip through the slip supply duct (6), removing one of the mold portions by applying compressed air to the water-drainage means (5, 5') of the mold portion to exude some water between the filter member and the resulting molded article, depressurizing the water-drainage means (5, 5') of the other mold portion to attract the molded article into the mold portion, hanging the molded article attracted into the mold portion, applying compressed air to the water-drainage means (5, 5') as described above, and thus demolding the molded article on the stand (9) safely.

Most defects observed in conventional manual operations have been eliminated by the U.S. Pat. No. 4,528,152 invention. Strictly speaking, however, there still remain some problems to be improved in automatically demolding hollow molded articles having large dimensions or having complicated shapes. When a heavy hollow article having large dimensions is hung from a mold portion, sometimes cracks or breakage is caused by its weight or deformation due to shrinkage takes place in the unsupported (demolded) portions of the molded article. In order to avoid such problems, longer deposition time or curing time is required. Moreover, it is sometimes difficult to demold a hollow article having complicated shapes such as concave configurations. Actually, it has been believed in the art that a large hollow article having complicated shapes such as stool sanitary ware can not be produced by an automatic demolding process without manual operations.

SUMMARY OF THE INVENTION

It is an object of the present invention to provide a method for drain-casting a slip effectively and efficiently by using a mold repeatedly to obtain a substantially hollow molded article.

It is another object of the present invention to minimize the time required for molding the article and for removing the molded article from the mold without deformation or damage.

It is a further object of the present invention to provide an apparatus therefor.

Other objects, features and advantages of the present invention will be apparent from the following description and drawings.

Incidentally, the term "drain-casting" used herein refers to the operation of cast-molding a slip into a hollow article by draining the undeposited slip remaining in a mold cavity. The term "substantially hollow molded article" used herein means both a molded article composed essentially of hollow parts and a molded article composed of hollow parts and solid parts such as a built-in washbowl and stool sanitary ware.

In accordance with the present invention, there is provided a method for drain-casting a slip to obtain a substantially hollow molded article, by the use of an apparatus comprising a divisible mold including an upper mold portion, a lower mold portion, and at least two side mold portions to be mated together and form a mold cavity, each mold portion including a pressure-proof air-tight vessel and a filter member inside the vessel, said filter member containing a means for draining water contained in the slip such as a water-drainage conduit placed at suitable intervals, said water-drainage means such as conduits being communicated with the openings outside of the vessel, one of said lower or upper mold portion having a slip supply duct; which method comprises the steps of filling the mold cavity with a slip supplied through the slip supply duct, pressurizing the slip to facilitate deposition of the slip onto the filter members of the mold to a desired thickness, water being drained from the mold, adjusting the position of the slip supply duct downward and draining the undeposited slip remaining in the mold cavity through the slip supply duct, applying compressed air to the water-drainage means of the upper and lower mold portions to exude some water between the filter members and the resulting hollow molded article, and removing the upper and lower mold portions, whereby the sides of the freshly molded article being held and supported between the filter members of the side mold portions to prevent the hollow article from cracks, breakage or deformation, applying a receiving stand under the partly demolded article, removing the side mold portions by application of compressed air to the water-drainage means of the side mold portions to exude some water between the filter members and the molded article, and demolding the molded article on the stand.

Normally, the side mold portions are simultaneously divided and removed to demold the molded article on the stand safely.

DETAILED DESCRIPTION OF THE INVENTION

Figure 1:
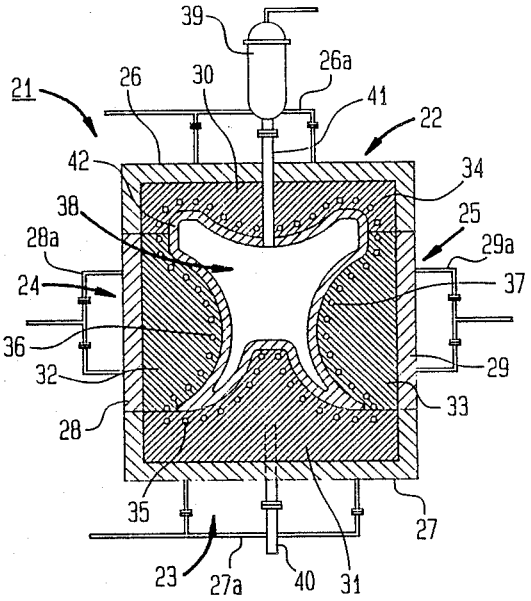
FIG. 1 is a partially sectional schematic elevational view showing an embodiment of the essential parts of the apparatus to be used in the present invention, wherein a hollow molded article for stool sanitary ware is obtained in accordance with the present invention.

In FIG. 1, a mold 21 includes at least four divisible mating mold portions consisting essentially of an upper mold portion 22, a lower mold portion 23, and side mold portions 24, 25 to form a mold cavity 38. Each of the mold portions includes a pressure-proof air-tight vessel 26–29 and a filter member 30–33 inside the vessel. The inner surfaces of the filter members define a shape of the article to be molded when the four mold portions are mated together. Each of the filter members 30–33 has therein a water-drainage means such as a water-drainage conduit 34–37 placed at suitable intervals. The water-drainage means (hereinafter referred to as a conduit or conduits) is communicated with the openings outside of the vessel. The upper mold portion 22 can have an overflow duct 41 at its top and the lower mold portion 23 has a slip supply duct 40 at its bottom, the ducts of which are communicated with the mold cavity 38 and with the openings outside of the vessels 26, 27.

Figure 4:
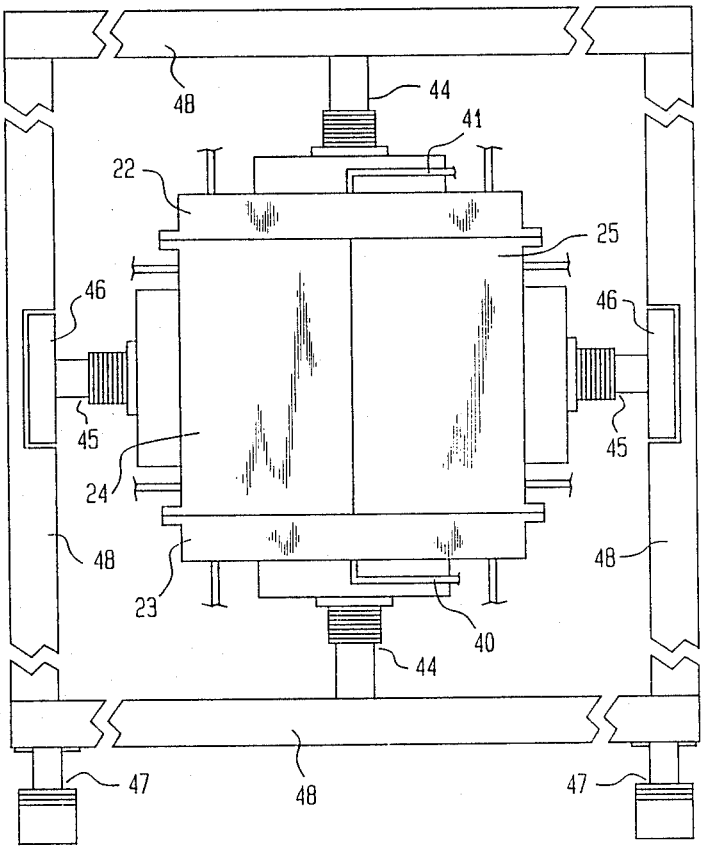
FIG. 4 is a schematic elevational view showing the mold and accessories in accordance with the present invention.
Figure 2:
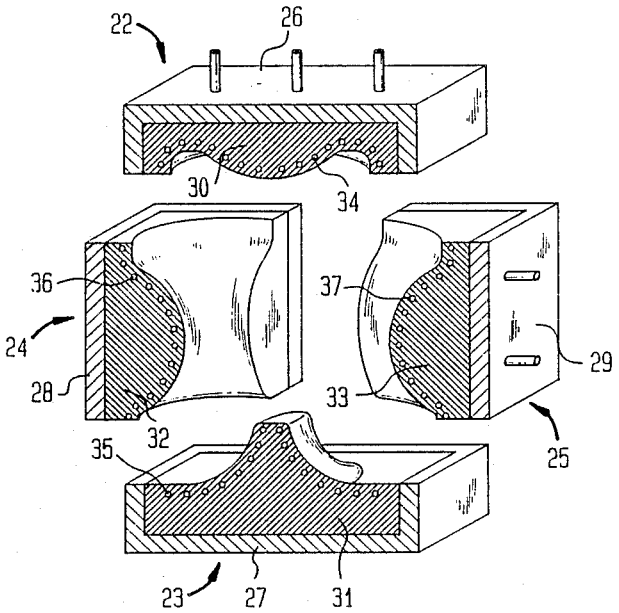
FIG. 2 is a perspective sectional view showing the four mold portions divided in four directions.

When the upper, lower, and side mold portions 22–25 are mated together, they are firmly fixed by rams 44, 45 as shown in FIG. 4 or by clamps at their outer flanges. The mold 21 is normally composed of four mold portions as shown in the drawings, but the mold portions and particularly the side mold portions can be designed to be further divided into a plurality of mold parts in accordance with the shapes and structures of the article to be molded.

The mold can be pipe-lined in the following way. An overflow tank 39 is desirably connected with the overflow duct 41, and is also connected with a three-way valve at its upper position. One end of the valve is opened to atmosphere and other end thereof is connected with an air-compressor (not shown in the drawing). The overflow tank, overflow duct and valve, however, may be avoided in a simple embodiment of the present invention.

Each of the outer tubings 26*a*–29*a* communicated with the water-drainage conduit 34–37 is connected with a gas-liquid separator. The separator (not shown) is equipped with a draining valve and a three-way valve. One end of the three-way valve is connected with an air-compressor (not shown) and the other end thereof is connected with a suction pump (not shown).

The slip supply duct 40 is connected through a flexible tube with a valve of a slip supply unit.

The slip supply unit is installed at a position lower than the mold 21 to utilize the gravity drop of the slip. The slip supply unit, however, may be set at a position higher than the mold 21 by the use of a slip-draining pump (not shown). A stand 43 to receive and carry a molded article 42 is equipped in a preferred embodiment. The table 43 includes a table lifter and a conveyor set thereon. The table lifter is movable from a waiting position (shown by two-dotted chain lines in FIG. 3) lo an article-receiving position (shown by full lines in FIG. 3).

Incidentally, the apparatus for drain-casting a slip shown in FIG. 1 comprises an upper mold portion 22 supported at an upper position, a lower mold portion 23 supported at a position under the upper mold portion, and side mold portions 24, 25; but the condition for combining the mold portions is not always restricted to such an embodiment. For example, a molded article having a substantially protuberant part is produced by designing the mold to contain the protuberant part in the lower mold portion, so that the undeposited slip can be readily drained. After the upper and lower portions are removed first, the side mold portions are turned upside down by means of turning means 46 as shown in FIG. 4, so that the molded article can be demolded safely on a stand. Incidentally, the molding apparatus to be used in the present invention is preferably equipped with rake-adjustment rams 47 as shown in FIG. 4 for draining the remaining undeposited slip. The rams 44, 45, 47 can be fixed to frame works 48 as shown in FIG. 4.

The above mentioned filter members 30–33 consist essentially of porous filter materials having a suitable cohesive or self-binding property which withstands the pressure to be applied to the filter members. The porous materials for the filter members include, for example, gypsum, porous cement materials, porous plastics, porous metal, porous ceramics, and mixtures thereof. From the viewpoint of efficiently fabricating a mold including the filter members, the porous materials for the filter may be preferably of a material dispersible or soluble in water or liquid. The above-mentioned water-drainage means such as conduits 34–37 are preferably composed of a permeable conduit such as tubes or cords which are more porous than the filter materials. Such permeable materials are not especially restricted as long as they are more permeable and porous than the filter materials. For example, a knitted fiber (e.g., cotton) tube having an outer diameter of about 2 mm to about 20 mm can be effectively used as a typical material therefor. Incidentally, examples of the porous plastics for the above mentioned filter members include epoxy resins, phenolic resins, water-containing polyester resins, foamed polyester resins, acrylic resins, mixtures thereof, etc. which can be incorporated with emulsifiers, curing agents, water, surfactants and/or fillers.

As to the arrangement of the porous tubes or the like for the water-drainage conduits in the mold portions, it is preferred that at least two continuous circuit tubes or the like are used in each mold portion and one or both ends of each tube be independently communicated with the openings outside of the vessel, in order to conduct drainage of water, pressurization to exude water and depressurization and also to provide for the local breakage of the filter member. In other words, it is preferred that the water-drainage conduit contained in each filter member be divided into a plurality of circuits composed of porous tubes or the like, and each of the circuits be independently communicated with the openings outside of the pressure-proof vessel. It is also preferred that both ends of each tube are communicated with the openings outside of the vessel, so that the filter material such as resins clogged in the conduit in the production of the mold portion can be washed out.

The preferred embodiments of the apparatus and especially of the filter members are given below. These data, however, can be readily modified by those skilled in the art on the basis of the present disclosure in accordance with the filter material to be used, the slip to be used, and other relevant factors.

(a) Effective thickness of the filter member

The effective thickness refers to a distance between the inner surface of the filter member and the water-drainage conduit. The thickness required depends on filtering characteristics and mechanical strength of the filter member. A porous sheet 1 mm or less thick having good mechanical strength may also the used. In the case of a fragile filter material such as gypsum, the thickness is determined in view of mechanical strength and is in the range of 1- to 8-fold thickness of the diameter of the water-drainage conduit, and preferably in the range of about 2- to about 5-fold thickness thereof. For example, a thickness of about 20 mm is used in the case of a knitted cotton tube conduit 10 mm in diameter. When the effective thickness is over 100 mm, it will sometimes become difficult to remove a molded article from the mold smoothly. The thickness can be thinner in the case of porous resin or porous metal materials.

(b) Porosity of the filter material

This also depends on the mechanical strength of the filter material and is generally in the range of 10% to 80%. In the case of gypsum, the porosity is preferably in the range of 30% to 60% and typically about 40% to about 45%.

(c) Pore size of the filter material

This may depend on the slip and pressure to be employed, and is generally in the range of 1 to 60 microns. In the case of gypsum, the pore size is preferably 1 to 40 microns and typically 1 to 30 microns. In the case of resin filter material, the pore size can be made smaller, for example, as small as 0.3 micron.

(d) Permeability variation of the filter member

The permeability of the filter member should be substantially uniform in principle, but a variation thereof up to about 15% is empirically allowable.

(e) Interval or distance between the water-drainage conduits

This depends upon the characteristics of the intended slip, the porous material for the conduit as well as the shape and size of the article to be molded. In the case of a knitted cotton tube 10 mm in its outer diameter, the interval between the conduits is in the range of 0 to 100 mm, preferably 5 to 60 mm and typically 10 to 50 mm.

The method for drain-casting a slip according to the present invention can be carried out in the following way by using the apparatus shown in the drawings.

A slip pressurized by the pump is supplied via the slip supply duct 40 into the mold cavity 38 formed by mating the four mold portions 22–25 together. The valve over the overflow tank 39 is opened to atmosphere in the course of supplying the slip. When the slip supplied reaches the overflow tank 39 via the overflow duct 41, the pressurizing pump is stopped and the valve below the slip supply duct is closed. Compressed air, e.g. about 5 to 15 kg/cm$^2$, is then supplied into the overflow tank 39 to pressurize the slip within the mold cavity 38. When the overflow tank 39 and duct 41 are not provided in a simple embodiment, the slip within the mold cavity is pressurized via the slip supply duct 40.

At the same time, the pressure within the outer tubings **26*a*–29*a* and water-drainage conduits 34–37 is made atmospheric pressure, or alternatively, is made negative pressure, e.g. about 300 to 700 mmHg. Thus, the pressurized slip within the mold cavity 38 is rapidly deposited onto the surfaces of the filter members 30–33 because water contained in the slip is expressed through the filter members into the drainage conduits 34–37 having lower pressure. After the deposition operation for a predetermined time, e.g. about 6 to 9 minutes for a deposition 9 mm thick, the pressure within the overflow tank 39 is decreased or returned to atmospheric pressure, or alternatively, atmospheric pressure or some pressure is applied to the mold cavity 38 through an opening or tubing communicated with mold cavity in the absence of the overflow duct 41. Thus, undeposited slip remaining in the mold cavity 38 is returned, by opening the valves, to the slip tank via the slip supply duct 40**. Incidentally, after draining the slip, compressed air may be used to repressurize the deposited slip and lower the water content thereof uniformly.

Then, compressed air is supplied into the water-drainage conduits 34, 35 of the upper and lower mold portions 22, 23 to exude some water remaining in the filter members 30, 31 between the surface of the filter members 30, 31 and the molded article 42 to form a water film between them. The lower and upper mold portions 22, 23 are separated from the side mold portions 24, 25 and moved downward and upward, while the molded article 42 is attracted by vacuum into the filter members 32, 33 to hold and support the molded article between the side mold portions. The stand 43 for the molded article is moved under the suspended article 42, and the table lifter is elevated to allow the stand to support the bottom of the molded article 42. Then, compressed air is supplied to pressurize the water-drainage conduits 36, 37. Thus, some water remaining in the filter members 32, 33 is exuded between the filter members and the molded article 42 to form a water film between them, and the molded article 42 is released from the side mold portions 24, 25 so that it rests on the stand 43 by gravity. The table lifter is then moved downward, the stand 43 for the molded article is moved to a waiting position shown by the two-dotted chain line in FIG. 3, and thus the hollow molded article 42 placed on the stand 43 is obtained. The four mold portions are mated together, and they are fixed or clamped for the next casting operation.

The preferred embodiments of the method for drain-casting a slip are given below. These data, however, can be readily modified by those skilled in the art on the basis of the present disclosure in compliance with the filter material, the slip characteristics and the like.

(i) Compositions of the slip to be used

A slip conventionally used for casting or drain-casting is successfully utilized in the present invention. The composition of the slip for ceramic ware is shown as an example in the following, wherein the percentages are approximate values by weight and the solid components may contain some moisture.

| | | |
|---|---|---|
| clays | 17 to 38% | (typically 24%) |
| pottery stone powder | 40 to 60% | (typically 48.5%) |
| feldspar | 10 to 20% | (typically 14%) |
| chamotte | 8 to 10% | (typically 9%) |
| dolomite | 0.1 to 1.0% | (typically 0.5%) |
| water on the basis of solid components | 35 to 50% | (typically 40%) |

(ii) Temperature of the slip

The temperature of the slip is generally in the range of 10° to 80° C., preferably 15° to 50° C. and typically 25° to 40° C. In practice, the slip is warmed up to about 28° C. or more in cold weather, and the slip is maintained at the above mentioned temperature range by agitation in mild or hot weather. Incidentally, the term "slip" used herein refers to a flowable aqueous suspension of fine powder comprising ceramic materials, resin materials or mixture thereof for casting or drain-casting maintained generally at a temperature given above.

(iii) Pressure applied to the slip in the deposition step

The pressure is in the range of 1 kgf/cm$^2$ to a safe pressure of the filter member, preferably about 5 to about 50 kgf/cm$^2$ and typically about 7 to about 30 kgf/cm$^2$.

(iv) Depressurization of water-drainage conduits in the deposition step

The pressure depends on the filter member and the conduit to be used. The depressurization may be zero, but is generally in the range of 10 mmHg to a safe pressure of the filter member, preferably about 200 mmHg or more, and typically about 500 mmHg or more.

Incidentally, in the course of deposition of a slip onto the filter members, the deposition velocity is not in proportion to the sum of the pressure applied to the slip and the pressure evacuated through the conduits. More specifically, in the first course of the deposition, the depressurization of the conduits does not make a large difference when the filter member is rather dry, but in the later course of the deposition, the deposition velocity and the hardness of molded articles are markedly increased by depressurizing the water-drainage conduits. Moreover, the depressurization of the conduits in the first course of the deposition may sometimes cause clogging of the filter members. It may be said that it is effective to conduct the depressurization of the conduits only in the later about ⅔ to 1/20 and preferably in the later about ½ to 1/10 course of the deposition step. Anyway, it is preferred that the depressurization of the water-drainage means be employed during, i.e. at least in some course of, the slip-deposition step of the present invention.

(v) Thickness of the deposited slip

The suitable thickness is generally in the range of about 3 mm to about 25 mm in the case of hollow molded articles and actually will be about 10 mm. The deposition amount and the molding time are substantially proportionate in this thickness range.

(vi) Surface hardness of molded articles upon removing the mold.

The hardness number is measured by a rubber-stamping hardness tester supplied by Peacock Company. In accordance with the present invention, the molded article having the following hardness can be demolded and placed on a stand without deformation or damage thereof;

Outer surface of molded articles 50 to 80 , preferably 60 to 80,

Inner surface of molded articles 20 to 40.

(vii) Pressure applied to the conduit to exude water upon removing the mold

The pressure depends on the filter member, and is generally in the range of 0.5 to 9 kgf/cm$^2$, preferably 1 to 7 kgf/cm$^2$ and typically 2 to 5 kgf/cm$^2$.

(viii) Evacuation of the conduits to attract the molded article into the filter members of side mold portions The depressurization is generally 10 mmHg or more, preferably 200 mmHg or more and typically 500 mmHg or more.

EXAMPLES

An apparatus as described above and illustrated in FIGS. 1 through 4 was used to carry out drain-casting operations to obtain hollow molded articles. The specifications of the apparatus used and conditions of the casting and demolding operations employed were as follows :

(a) Effective thickness of the filter member; about 70 mm.

(b) Filter material; gypsum or porous epoxy resin.

(c) Mean pore size of the filter material; about 3 microns (gypsum) about 1.5 microns (epoxy resin)

(d) Permeability variation; about 10%

(e) Interval between water-drainage conduits; about 30 mm (f) Material and outer diameter of the conduit; knitted cotton tube, about 10 mm (i) Composition of the slip used; composed of the afore-described typical composition (ii) Temperature of the slip; about 30° C.

(iii) Pressure applied to the slip in the deposition step; about 10 kgf/cm$^2$ (iv) Depressurization of water-drainage conduits in the deposition step; about 500 mmHg in the later ½ course thereof.

(v) Mean thickness of the deposited slip; about 9 mm.

Figure 3:
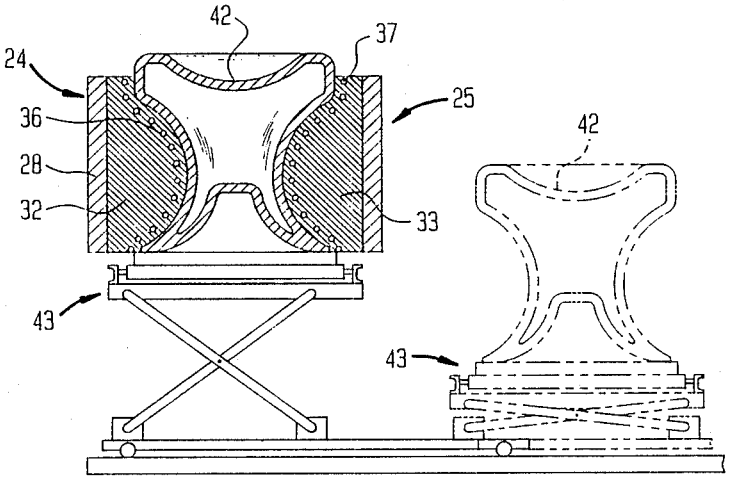
FIG. 3 is a partially sectional elevational view showing an embodiment of demolding in accordance with the present invention.
Figure 5:
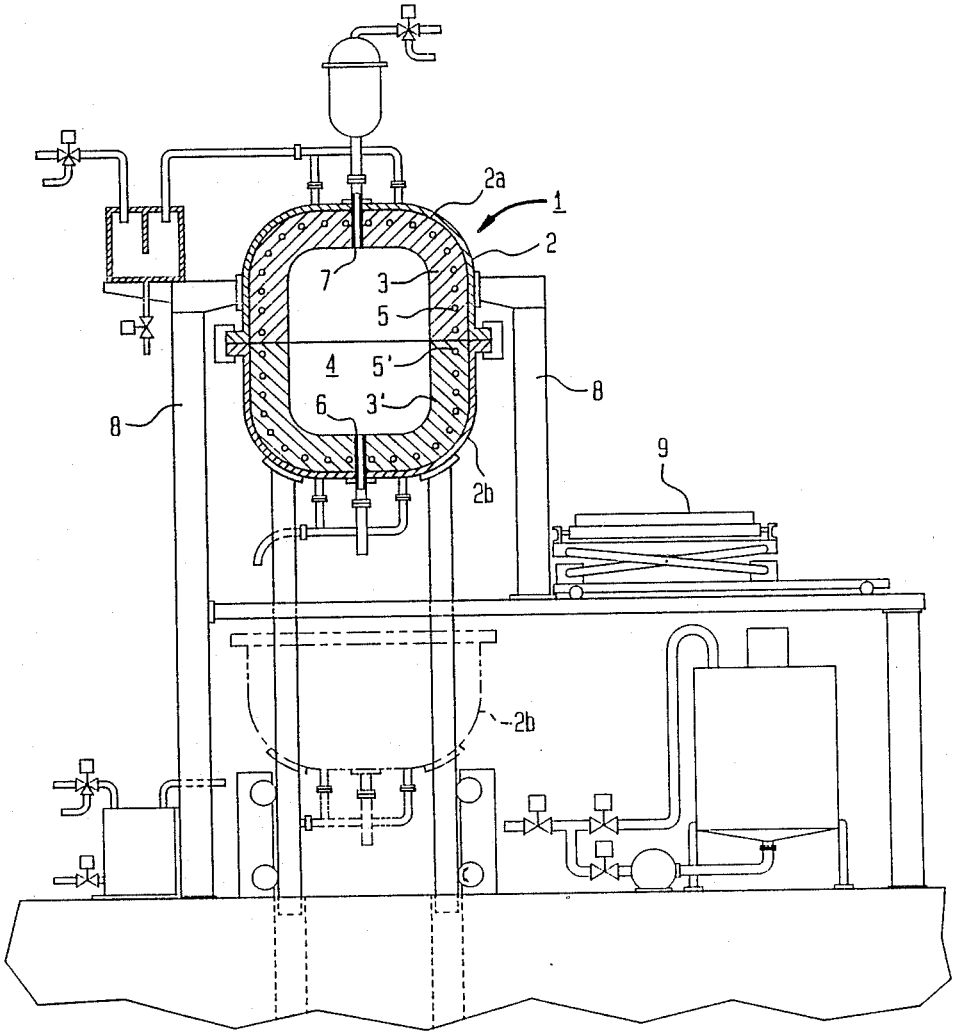
FIG. 5 (PRIOR ART)
FIG. 5 is a partially sectional schematic elevational view showing a prior art apparatus for drain-casting a slip to obtain a hollow molded article.

The hollow molded articles for stool sanitary ware similar to those illustrated in FIGS. 1 and 3 were produced in accordance with the present invention. The deposition step commencing the supply of the slip and ending the drainage of the slip took about 10 minutes with the gypsum mold, and about 7 minutes with the epoxy resin mold. The subsequent step for demolding the molded article on a stand safely without deformation or damage thereof took about 1 minute with the gypsum mold, and about 0.5 minute or more with the epoxy resin mold.

Incidentally, the duration of the gypsum mold was about 500 molding cycles in the present process. That of the porous epoxy resin mold was estimated by the present inventor to be about 10,000 molding cycles.

In the practice of the present invention, the step of depressurizing the water-drainage means or conduits 36, 37 of the side mold portions, when the upper and lower mold portions are removed and the molded article is suspended, is not always necessary, as long as the hollow molded article is firmly held and supported due to the cohesion of deposited slip between the filter members 32, 33 of the side mold portions 24, 25. In other words, pressurizing the slip to effect deposition of the slip onto the filter members of the mold to a desired thickness may result in cohesion of the deposited slip on the filter members being effected so as to firmly hold and support the molded article due to such cohesion. The depressurization of the side mold portions, however, can be employed to support the molded article more firmly.

Incidentally, the slip supply duct 40 illustrated in the partially sectional view of FIG. 1 looks not to reach the mold cavity 38; however, it is to be noted that the duct 40 is communicated with the lowest portion of the mold cavity 38 at a position not shown on the section of FIG. 1. Thus, undeposited slip remaining in the mold cavity is readily drained via the slip supply duct 40.

As described above in detail, one of the features of the present invention is to remove the upper and lower mold portions first upward and downward, respectively and then to remove the side mold portions sideways, the four mold portions being movably supported by outer supporting members such as the frame works 48 or the like; whereby demolding a hollow molded article on a stand safely. Thus, the following excellent effects, among others, are realized in accordance with the present invention.

(1) An automatic process for obtaining a hollow molded article can be readily carried out very rapidly without possible cracks, breakage, deformation and other damage, because the molded article is firmly held and supported between the side mold portions prior to demolding the article on the stand. Also, the deposition time of a slip and curing time of the molded article are shortened because such possible damage is eliminated, in comparison with those required in conventional processes.

(2) A hollow molded article having complicated shapes such as concave configurations on the side surfaces of the molded article can be automatically demolded on the stand without manual operations, which has been demolded by troublesome manual operations in conventional processes.

(3) By removing the upper and lower mold portions first and then the side mold portions, a wear loss of the filter members due to the sliding friction between the side mold portions and the lower mold portion is eliminated according to the present invention. Incidentally, in conventional process using a mold comprising four or more divisible mold portions, side mold portions are manually removed first before removing a lower mold portion, because a molded article can not be successfully supported by the side mold portions. Thus, the filter members of the mold portions have been suffered from the above mentioned friction-wear loss upon removing the side mold portions, which was a serious problem in view of duration of such molds.

What is claimed is:

1. A method for drain-casting a slip to very rapidly obtain a substantially hollow molded article automatically without substantial manual operations, by the use of an apparatus comprising a divisible mold including an upper mold portion, a lower mold portion, and at least two side mold portions to form a mold cavity, the mold portions being moveably supported by outer supporting members, each mold portion including a pressure-proof airtight vessel and a filter member inside the vessel, said filter member containing a water drainage means, said water-drainage means being communicated with the openings outside of the vessel, one of said lower or upper mold portion having a slip supply duct; which method comprises the steps of filling the mold cavity with a slip supplied through the slip supply duct, pressurizing the slip to facilitate deposition of the slip onto the filter members of the mold to a desired thickness, cohesion of the deposited slip onto the filter members being effected and water being drained from the mold, adjusting the position of the slip supply duct downward and draining the undeposited slip remaining in the mold cavity through the slip supply duct, thereafter in the presence of the cohesion, applying compressed air to the water-drainage means of the upper and lower mold portions to exude some water and from a water film between the filter members and the resulting hollow molded article cohered on the filter members, removing the upper and lower mold portion in the presence of the water film, while firmly holding and supporting the cohesion without vacuum the freshly molded article between the filter members of the side mold portions in a suspended fashion to prevent the hollow article from cracking, breaking and deforming, thereafter applying a receiving stand under the partly demolded article thus held and supported, removing the side mold portions by application of compressed air to the water-drainage means of the side mold portions to exude some water and form a water film between the filter members and the molded article cohered on the filter members, and demolding the molded article in the presence of the water film on the stand without deformation or damage of the molded article.

2. The method according to claim 1, in which the water-drainage means is a water-drainage conduit.

3. The method according to claim 1, in which the slip is a flowable aqueous suspension of a ceramic material.

4. The method according to claim 1, in which porous material for the filter member is selected from the group consisting of gypsum, porous cement materials, porous plastics, porous metal, porous ceramics, and mixtures thereof,

5. The method according to claim 4, in which the porous plastic material is selected from the group consisting of epoxy resins, phenolic resins, polyester resins, acrylic resins, and mixtures thereof.

6. The method according to claim 1, in which the water-drainage means contained in the filter member of a mold portion is divided into a plurality of circuits and each of the circuits is independently communicated with the openings outside of the pressure-proof vessel.

7. The method according to claim 1, in which both ends of a water-drainage means are communicated with the openings outside of the pressure-proof vessel.

8. The method according to claim 1, in which the slip in the mold cavity is pressurized via the slip supply duct to facilitate deposition of the slip.

9. The method according to claim 1, in which the upper mold portion has an overflow duct and the lower mold portion has a slip supply duct.

10. The method according to claim 9, in which the slip in the mold cavity is pressurized via the overflow duct to facilitate deposition of the slip.

11. The method according to claim 1, in which a substantially hollow molded article having complicated shapes on the side surfaces thereof is produced.

12. The method according to claim 1, in which during the pressurization of the slip the water-drainage means are depressurized.

13. The method according to claim 12, in which the depressurization of the water-drainage means is conducted in the later, about ⅔ to about 1/20, course of the deposition step.

14. The method according to claim 1, in which after draining the slip compressed air is supplied to pressurize the deposited slip and lower the water content of the molded article.

15. The method according to claim 1, in which the water-drainage means is composed essentially of a permeable tube or cord which is more porous than the filter member.

16. The method according to claim 15, in which the permeable tube is a knitted fiber tube.

17. The method according to claim 1, in which at least one of said mold portions is further divided into a plurality of mold parts.

18. The method according to claim 1, in which the upper and lower mold portion are removed first, the side mold portions are turned upside down, and the article is demolded onto the stand.

19. The method according to claim 18, in which a molded article having a substantially protuberant part is produced by providing the mold to contain the protuberant part in the lower mold portion having a slip supply duct.

20. The method according to claim 1, in which a substantially hollow molded article having a concave shape on the side surface thereof is produced.

21. The method according to claim 1, in which a substantially hollow molded article having heavy weight and large dimensions is produced.

* * * * *